US005215628A

United States Patent [19]

Koivuranta et al.

[11] Patent Number: 5,215,628

[45] Date of Patent: Jun. 1, 1993

[54] TWIN-WIRE WEB FORMER IN A PAPER MACHINE

[75] Inventors: Mauri Koivuranta, Petäjävesi; Michael Odell, Jyväskylä; Erkki Partanen, Jyväskylä; Lauri Verkasalo, Jyväskylä, all of Finland

[73] Assignee: Valmet Paper Machinery Inc., Finland

[21] Appl. No.: 754,573

[22] Filed: Sep. 4, 1991

[30] Foreign Application Priority Data

Sep. 12, 1990 [FI] Finland ..... 904489

[51] Int. Cl.[5] ..... D21F 1/00

[52] U.S. Cl. ..... 162/301; 162/300; 162/352

[58] Field of Search ..... 162/300, 301, 303, 352

[56] References Cited

U.S. PATENT DOCUMENTS

| | | | |
|---|---|---|---|
| 3,438,854 | 4/1969 | Means | 162/303 |
| 3,846,232 | 11/1972 | Kankaanpaa | 162/301 |
| 3,941,651 | 3/1976 | Koski | 162/301 |
| 3,994,774 | 11/1976 | Halme et al. | 162/352 |
| 3,996,098 | 12/1976 | Kankaanpaa | 162/301 |
| 3,997,390 | 12/1976 | Kankaanpaa | 162/132 |
| 4,113,556 | 9/1978 | Kankaanpaa | 162/272 |
| 4,154,645 | 5/1979 | Kankaanpaa | 162/133 |
| 4,609,435 | 9/1986 | Tissari | 162/203 |
| 4,735,686 | 4/1988 | Skytta | 162/203 |
| 4,769,111 | 9/1988 | Nevalainen et al. | 162/301 |
| 4,790,909 | 12/1988 | Harwood | 162/301 |
| 4,879,001 | 11/1989 | Cronin | 162/301 |
| 4,960,492 | 10/1990 | Weitzel et al. | 162/301 |
| 4,988,408 | 1/1991 | Evalhati | 162/301 |

FOREIGN PATENT DOCUMENTS

| | | |
|---|---|---|
| 960496 | 1/1975 | Canada . |
| 2105613 | 8/1975 | Fed. Rep. of Germany . |
| 751774 | 6/1975 | Finland . |
| 852291 | 6/1985 | Finland . |
| 843081 | 2/1986 | Finland . |
| 851650 | 10/1986 | Finland . |
| 885606 | 6/1990 | Finland . |
| 902283 | 7/1990 | Finland . |
| 852662 | 2/1991 | Finland . |
| 885609 | 9/1991 | Finland . |

*Primary Examiner*—Karen M. Hastings
*Attorney, Agent, or Firm*—Steinberg & Raskin

[57] ABSTRACT

A twin-wire web former in a paper machine includes a covering wire and a carrying wire defining a forming zone, at the beginning of which zone there is a forming gap into which the discharge opening of a headbox feeds a pulp suspension jet. A first forming roll is located on the twin-wire zone, in the area of the forming gap, on which the twin-wire zone is curved within a certain sector, followed by a dewatering unit(s), which is in turn followed by a second forming roll(s) in the twin-wire zone. Thereafter, the web is detached from the covering wire and passed on the carrying wire to a pick-up point. Between the first forming roll and the second forming roll(s), a dewatering unit(s) is provided which comprises a press-support unit which guides the wire that enters into contact with the unit as a straight run. The dewatering unit(s) also includes a dewatering equipment facing the press-support unit and provided with suction and foil equipment for removing a substantial amount of water out of the web. The magnitude of the twin-wire turning sector placed in connection with the first forming roll is within the range of from about 35° to about 120°.

17 Claims, 5 Drawing Sheets

TWIN-WIRE WEB FORMER IN A PAPER MACHINE

BACKGROUND OF THE INVENTION

During the last 20 years, various manufacturers have introduced a number of web formers operating by the twin-wire principles. A review of such web formers was published in the journal *Pulp & Paper,* Sep. 1982. In addition to the web formers mentioned in the aforementioned review, or in relation to them, reference is made to the following patent/publications: Canadian 960,496; Fed. Rep. Germany 2,105,613; U.S. Pat. No. 3,438,854; U.S. Pat. No. 3,846,232; U.S. Pat. 3,941,651; U.S. Pat. No. 3,997,390; U.S. Pat. No. 4,113,556; U.S. Pat. No. 4,154,645; and U.S. Pat. No. 4,609,435. Reference is also made to applicant's U.S. Pat. No. 3,996,098, corresponding to applicant's FI Patent Application No. 751774, as well as to applicant's FI Patent Application Nos. 843081 and 852291.

Applicant's FI Patent Application No. 751774 (corresponding to U.S. Pat. No. 3,996,098) and FI Patent Application Nos. 851650, 852662 and 902283, describe web-formers which are marketed by the applicant under the trademark "Speed-Former". The "Speed-Former" web formers can be characterized as roll-shoe formers, because the upper forming roll acts as a dewatering member to quite a limited extent only, because the twin-wire forming zone defined on it is quite narrow, and there are no means for drawing of the water around it. Thus, the main function of said upper roll is to make sure that the web is separated from the covering wire and follows the carrying wire.

In these web forming sections, the need for further development has occurred in particular in the case of papers manufactured out of slowly filtered pulp types, such as SC paper, and at particularly high machine speeds. In order to satisfy said needs of further development so that it is possible to guarantee a sufficiently high dry solids content after the wire part with all the pulp qualities used and with all web speeds, the web former described in the applicant's afore-mentioned FI Patent Application No. 902283 has been developed, in whose roll-shoe roll former a considerable proportion of dewatering is carried out on the last (second) forming roll, in whose connection the necessary dewatering equipment is fitted so that, on the last forming roll, the dry solids content of the web is increased further by about 3–5 percent.

With respect to the prior art related to the present invention, reference is further made to applicant's FI Patent Application No. 885609, and to the FI patent Application Nos. 885606 and 885607 of Valmet-Ahlstrom, Inc., in which web formers marketed under the trademark "MB-former" are described.

With increasing running speeds of paper machines, several problems in the web formation have been manifested with more emphasis. In the web former of a paper machine, the phenomena that affect the fiber mesh and the water, which is still relatively free in connection with the fiber mesh, such as centrifugal forces, are, as a rule, increased in proportion to the second power of the web velocity. The highest web speeds of the present day newsprint machines are of an order of 1200 m/min. However, newsprint machines are being planned in which a web speed of up to about 1500 m/min is aimed at.

It is therefore an object of the present invention to further development the web formers described in applicant's FI Patent Application No. 751774 (corresponding to U.S. Pat. No. 3,996,098) and FI Patent Application Nos. 851650, 852662 and 902283.

A further object of the invention is to provide a twin-wire gap former whose dewatering capacity and efficiency can be increased in comparison to the roll-shoe formers of the "Speed Former" type and with other, corresponding formers.

A further object of the present invention is to provide a twin-wire former in which an increased proportion of dewatering can be carried out on the first forming roll without deterioration of the formation.

It is a further object of the invention to provide a twin-wire former which is suitable for different paper qualities also be relatively thick paper qualities and for pulps whose dewatering is relatively difficult.

Further objects of the invention are to provide a former in which the formation of the paper produced is good and the porosity of the paper is low, i.e. there are no so-called pinholes in the paper.

SUMMARY OF THE INVENTION

In view of the achieving the objectives stated above and others, the present invention is related to a twin-wire web former in a paper machine comprising a covering wire and a carrying wire, the wires forming a twin-wire forming zone with one another. At the beginning of the zone, there is a forming gap or board into which the discharge opening of a headbox feeds a pulp suspension jet. A first forming roll is located in the area of the forming gap. The twin-wire forming zone is curved on the first forming roll within a certain sector, which is followed by a dewatering unit or units. The dewatering unit or units is/are followed by a second forming roll or group of rolls in the twin-wire zone. Thereafter, the web is detached from the covering wire and passed on the carrying wire to the pick-up point.

Between the first forming roll and the second forming roll or the corresponding group of rolls, a dewatering unit or units is/are provided, which comprise(s) a press-support unit which guides the wire that enters into contact with said unit as a substantially straight run. The dewatering unit or units comprise(s) a dewatering equipment placed facing the press and support unit and provided with a suction and foil equipment. The suction and foil equipment removes a substantial amount of water out of the web. The magnitude a of the twin-wire turning sector placed in connection with said first forming roll is preferably within the range of from about 5° to about 120°, and more preferably within the range of from about 35° to about 55°, and can also be within the range of from about 35° to about 120°.

In the invention, two prior art wire parts have been combined in a novel way, i.e. the applicant's "Speed-Former" TM and the above "MB-former" TM. According to the invention, when the ribbed shoe in the prior art "Speed-Former" TM is replaced by a "MB-former" TM unit or units, by means of the MB-unit, a more intensive pulsating dewatering pressure can be applied to the pulp web, which pressure can be controlled and regulated better than in the case of a ribbed shoe. Thus, the web can be introduced into the first MB-unit as having an increased input dry solids content. This has beneficial results in that with regard to the first former roll, higher covering angles can be used without deterioration of the formation.

In the invention, the covering angle of the twin-wire zone on the first forming roll is from about 45° to about 120°. In contrast, in the prior art "Speed-Formers" TM the covering angle of the twin-wire zone on the first forming roll is from about 35° to about 45°. Owing to the large covering angle, increased amounts of water are drained within said sector, i.e., about 40 to 80 percent of the overall amount of water to be drained in the former.

Thus, when the web arrives in the MB-unit, its dry solids content is of an order of $K_1$=2–8%.

Owing to the higher dewatering proportion that can be filtered on the first forming roll of the MB-unit or units fitted in accordance with the invention, the web former in accordance with the invention is also suitable for use for relatively thick paper qualities and for pulps whose dewatering is more difficult than average.

BRIEF DESCRIPTION OF THE DRAWINGS

In the following, the invention will be described in detail with reference to some embodiments of the invention illustrated in the figures in the accompanying drawing, the invention being by no means strictly confined to the details of said embodiments.

DETAILED DESCRIPTION

Figure 1:
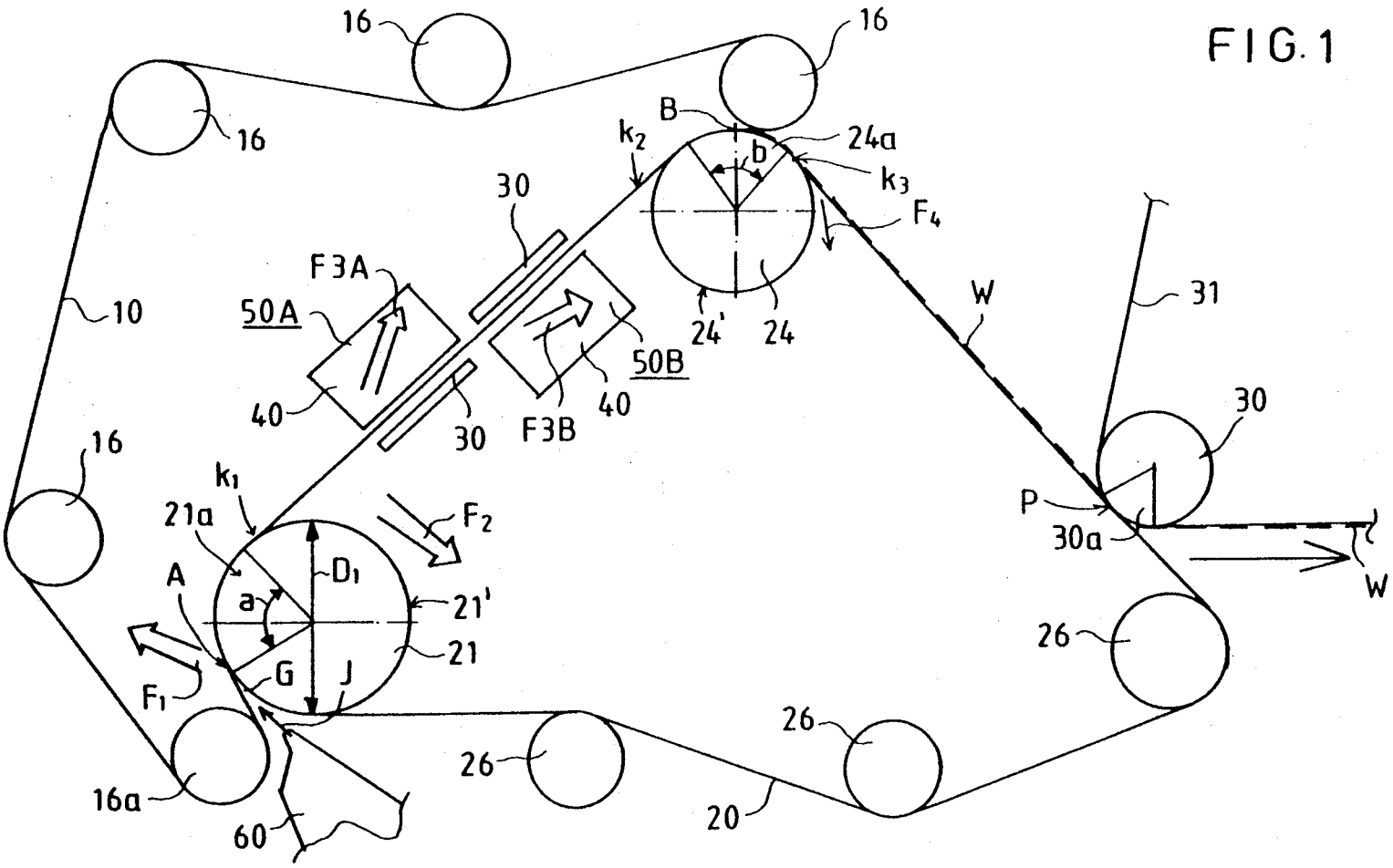
FIG. 1 is a schematic side view of an embodiment of the invention wherein both of the forming rolls are inside the loop of the carrying wire.

The web formers illustrated to FIGS. 1 to 4 comprise a loop of the covering wire 10 and a loop of the carrying wire 20. The wires 10,20 have a joint run between the lines A and B, which define the twin-wire forming zone in the former. After the twin-wire forming zone A-B, the web W follows the carrying wire 20. The discharge part 60 of the headbox feeds a pulp jet J into the gap G defined by the wires 10 and 20, which gap is formed as determined by the relative positions of the rolls **21,16*a*;26*a*, 11. At one side, the gap G is formed mainly by the run of the wire 10;20 from the roll 16*a*;26*a* to the line A, where the wire 10;20 meets the other wire 20;10 (the pulp layer is placed in between). At the other side, the forming gap G is defined by the wire 20;10 running over the first forming roll 21;11. In some cases, before the sector a of the forming roll 11;21, it is possible to use a short forming board, to whose beginning the pulp jet J is fed before it enters into contact with both of the wires 10,20**. However, the preferred embodiment of the invention is expressly a gap former.

As is shown in FIGS. 1 to 4, the first forming roll 21;11 is a forming roll provided with an open face 21'; 11', which has a relatively large diameter and is provided with a suction box **21*a*;11*a*. The diameter of the first forming roll 21;11 is, for example, $D_1$=from about 1.5 to about 2 m. On the sector a of the first forming roll 21;11, the dewatering takes place substantially away from the forming roll 21;11 in the direction of the arrows $F_1$ and to some extent into the open face 21'; 11' of the roll 21;11**.

As an important dewatering and carrying unit, the twin-wire formers shown in FIGS. 1 to 4 include a MB-unit 50, of which there are two units 50A and 50B placed one after the other in FIG. 1. The MB-unit 50 or units 50A and 50B comprise dewatering means 40 and a press and support unit 30, between which the wires 10 and 20 and the pulp web W placed between them run. In FIG. 1, the latter unit 30 is placed above, so that it is a backup unit and not a "support unit" proper. The press and support unit 30, which belongs to the MB-unit and which will be described in more detail later, guides the twin-wire zone as a straight run and presses it against the dewatering means 40. Dewatering towards the support unit 30 through the wire placed against said unit is, as a rule, little, also in respect of the dewatering by the force of gravity. Thus, in connection with the MB-unit 50 or units 50A, 50B, the dewatering takes place towards the equipment 40 provided with suction and foil devices, in the direction of the arrow F3 or the arrows F3A and F3B.

In FIG. 1, before the second forming roll 24, there are two MB-units 50A and 50B placed one after the other, which operate inversely in relation to one another so that in the first unit 50A the dewatering takes place in the direction of the arrow F3A towards the dewatering means 40 through the covering wire 10, whereas in the latter unit 50B the dewatering takes place in the direction of the arrow F3B towards the equipment 40 through the carrying wire 20. One exemplifying embodiment of the construction of the MB-units 50;50A and 50B will be described in more detail later with reference to FIG. 5.

Figure 2:
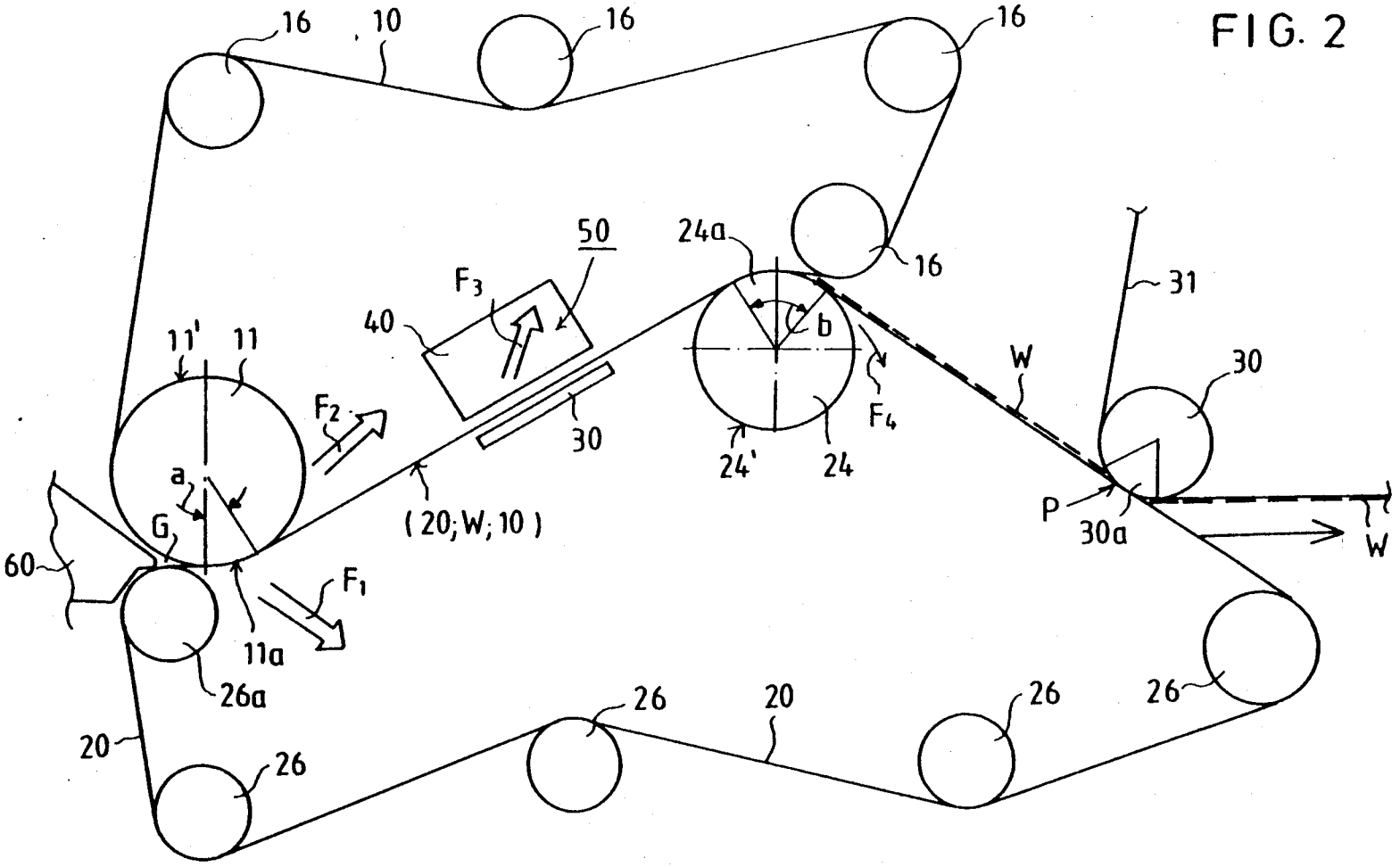
FIG. 2 shows, in a way corresponding to FIG. 1, an embodiment of the invention wherein the first forming roll is inside the loop of the covering wire and the second forming roll inside the loop of the carrying wire.
Figure 3:
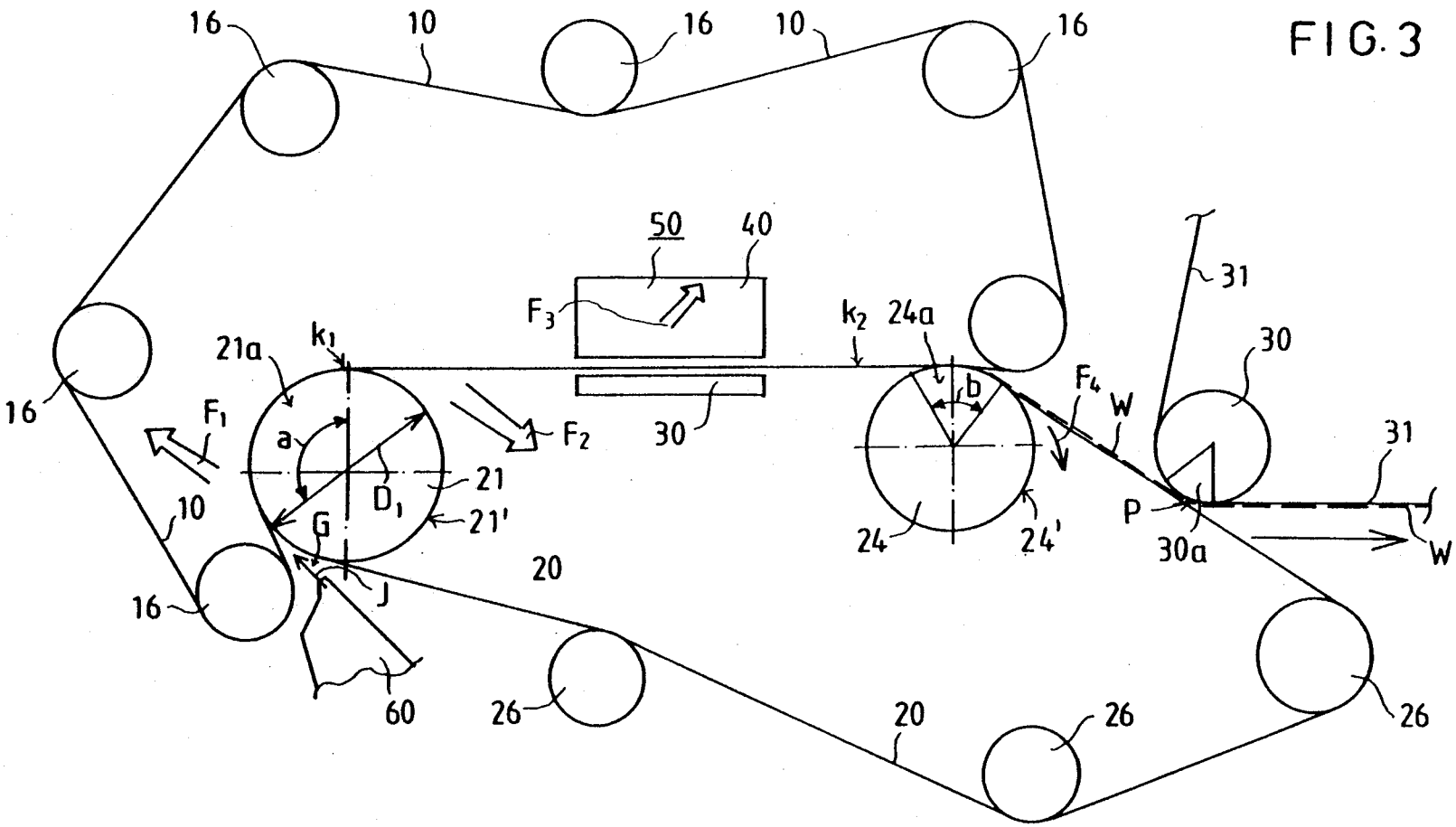
FIG. 3 shows an embodiment of a web former of the invention in which the twin-wire forming zone between the forming rolls is substantially horizontal.

As is shown in FIGS. 1 to 3, the MB-unit 50 or units 50A, 50B is/are followed by the second forming roll 24, which is placed inside the loop of the carrying wire 20 and in whose area, on the sector b, the run of the wires 10,20 is turned to be curved towards the pick-up point P. After the second forming roll 24, the web W proceeds to the line P, at which it is detached from the wire 20 by means of the pick-up roll 30 and its suction zone **30*a* and is transferred onto the pick-up fabric 31**, which carries the web W further to the press section (not shown) of the paper machine.

Figure 4:
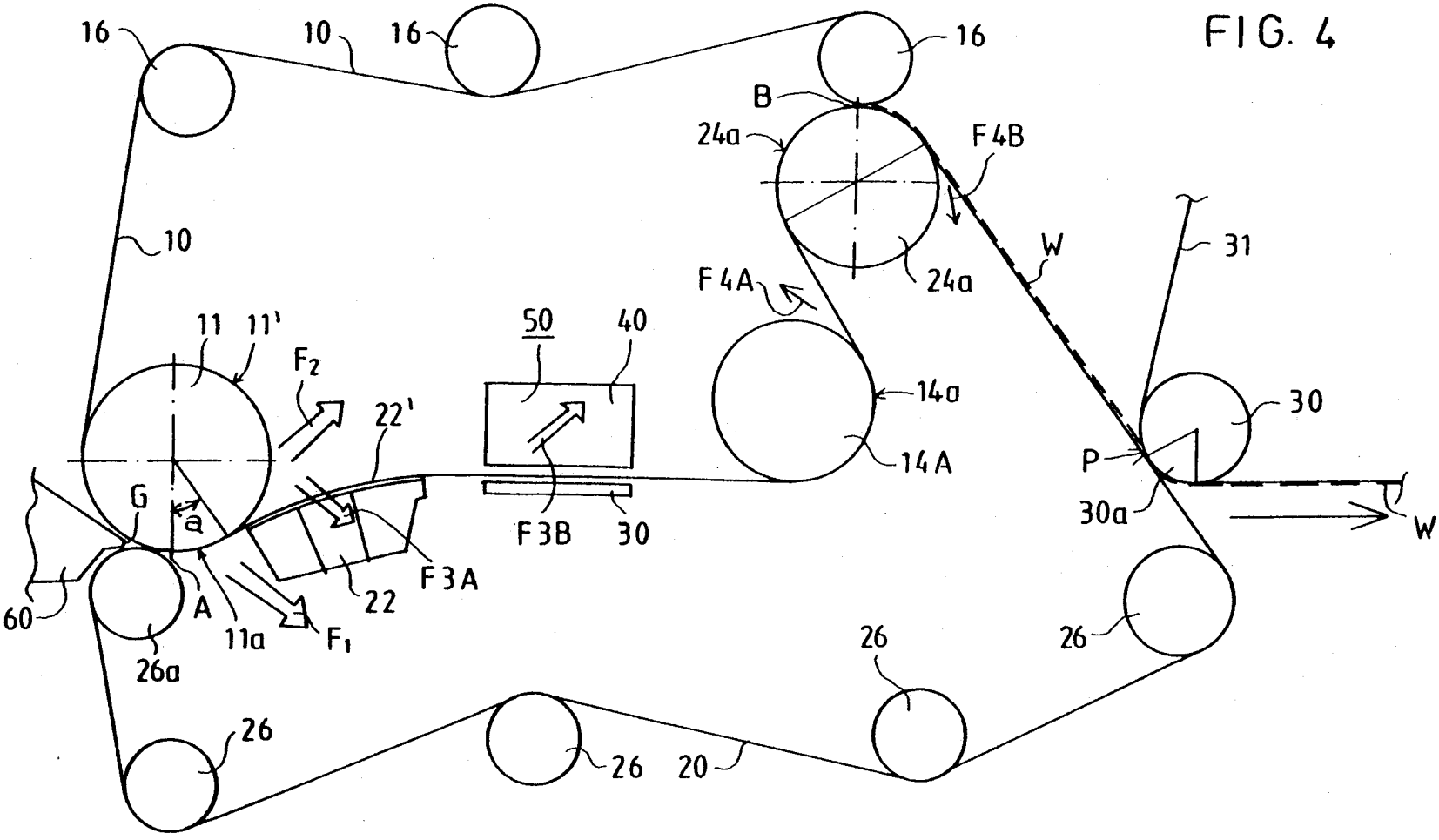
FIG. 4 shows such a horizontal version of the invention in which, before the MB-unit, a forming roll and a forming shoe are used and, as the latter forming-roll unit, a pair of forming rolls is used in which the forming rolls are placed one above the other.

FIG. 4 shows such a horizontal version of the invention in which the twin-wire forming zone, which starts at the suction zone **11*a* of the first forming roll 11, is substantially horizontal in its initial part. Inside the loop of the carrying wire 20, there is a forming shoe 22, which is provided with an open ribbed deck 22', through which an effect of negative pressure is applied to the fibre web that is being formed, through the wire 20. The forming shoe 22 is followed by the MB-unit 50, which comprises dewatering means 40 placed inside the loop of the covering wire 10 and a press support unit 30 inside the loop of the carrying wire 20**.

After the MB-unit 50, the twin-wire zone has a horizontal joint run, after which said zone is guided and turned upwards by a first forming-suction roll 14A, which is placed inside the loop of the covering wire 10 and in whose suction zone **14*a* the run of the wires 10,20 is turned at an angle of 90°, being inclined upwards, onto the second forming-suction roll 42A, on whose suction zone 24*a* the joint run of the wires 10,20 is turned into a downwards inclined run of the substantially opposite direction. At the beginning of this run, the covering wire 10 is detached from the web W, which follows the run of the carrying wire 20 to the pick-up point P, where the web W is transferred onto the pickup fabric 31 on the suction 30A of the pick-up roll 30**.

In FIG. 4, the mantle 11' of the first forming roll 11 is perforated, and the roll has a suction zone 11*a*. The headbox 60 feeds the pulp suspension jet into the forming gap G between the wires 10 and 20. The forming-suction rolls 14A and 24A are placed one above the other, and, from the point of view of the dewatering and formation of the web W, the pair of rolls 14A,24A operates in a way substantially equivalent to the second forming roll 24 described in FIGS. 1, 2 and 3.

Figure 5:
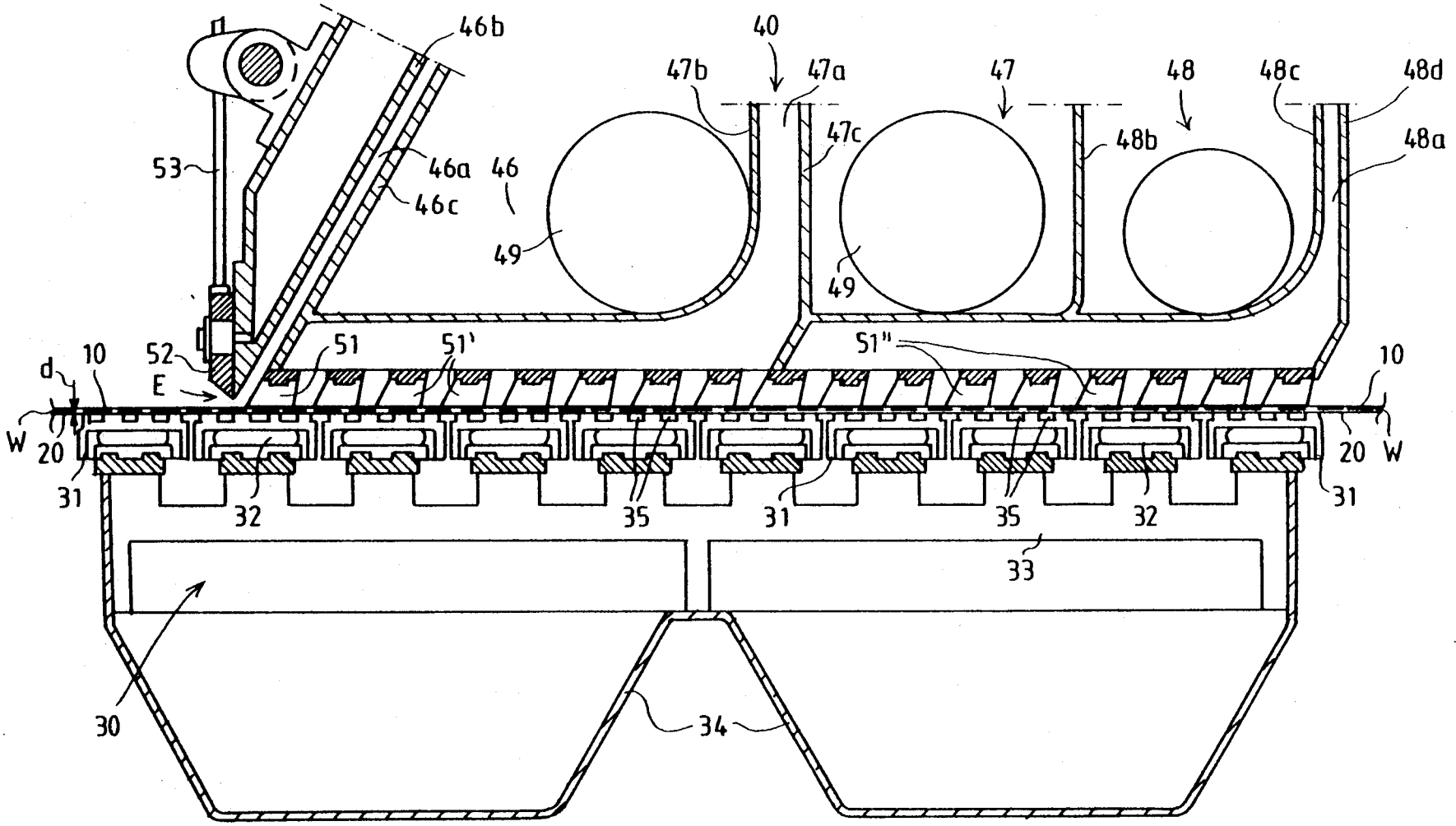
FIG. 5 shows an exemplifying embodiment of the MB-unit employed in the invention.

FIG. 5 shows the MB-unit 50, which is included in the formers shown in FIGS. 1 to 4 which comprises dewatering means 40 and a plane wire press and support unit 30 (in FIG. 1, in respect of the unit 50B, a press and backup unit 30) jointly operative with said dewatering means 40.

The dewatering means 40 consist of an integrated combination of, as a rule, two to four (in the figures three) suction and water-collecting chambers 46,47,48 wherein the individual chambers are separated from each other by partition walls 47*b* and 48*b*. Each chamber 46,47,48 is provided with an air opening (not shown) communicating with a suction source as well as with a drawing water duct 49. The water-collecting duct 46*a*, which belongs to the first suction chamber 46, is formed between the beam 46*b* and the guide plate 46*c*. At the later end of the duct 46*a*, there is a transverse foil doctor 51 and a rib 52 which can be set by means of adjusting spindles 53, said doctor and rib forming a slot E that extends across the width of the former and can be adjusted locally and through which slot E the water that is compressed out of the pulp layer W between the wires 10 and 20 flows into the first chamber 46.

The foil doctor 51 in the dewatering means 40 shown in FIG. 5 is followed by a number of similar foils 51' and 51'', whose lower faces are in the same plane. The foils 51' collect the water that is separated from the fiber mesh at the first suction chamber 46, but below the chamber. The water is passed into the suction chamber 47 through the duct 47*a*, which is formed between the partition wall 47*b* and the guide plate 47*c*. In a corresponding way, the water collected by the following foils 51'' is guided into the third suction chamber 48 through the duct 48*a*, which is formed between the rear wall 48*d* of the dewatering means and the guide plate 48*c*.

The duct 46*a* shown in FIG. 5 and the related foil doctor 51 and adjusting rib 52 form a suction-aided dewatering member. When relatively thick qualities are being produced by means of the former at low speeds, the operation of the autoslice system should be preferably aided by means of suction, the vacuum being preferably from about 6 to about 8 kPa. At this state, the amount of the dewatering directed upwards and partly also the extent of the vacuum that is produced can be affected by adjusting the height of the slot E between the rib 52 and the foils 51.

In FIG. 5, the dewatering effect of the suction-aided dewatering member and of the related first suction chamber 46 is local, being confined to the proximity of the tip of the first foil doctor 51. The dewatering area of the second suction chamber 47 is wider, being determined by the number of the foils 51'. For example, in FIG. 5, this number is shown to be seven. The effect of the foils 51' is based on joint operation with the wire support means 30 placed inside the loop of the lower wire 20. It is an important feature of the press and support unit 30 and of its operation that, by its means, in the area of the dewatering means 40 it is in the desired way possible to produce a gradually increasing compression by the lower wire 20 applied to the web W that is being formed, by the effect of which compression the dewatering of the web W takes place substantially through the loop of the upper wire 10 into the suction duct 47*a* and through it into the suction chamber 47. The operation of the third suction chamber 48 is analogous to the second suction chamber 47.

The negative pressure prevailing in the second and third chamber 47,48 in FIG. 5 is preferably considerably higher than in the first chamber, i.e. from about 10 to about 20 kPa in the chamber 47, and from about 15 to about 30 kPa in the chamber 48, depending on the web material that is being manufactured.

The beam members 31 of the press and support equipment 30 shown in FIG. 5 rest on longitudinal support beams 33 by the intermediate of rubber hoses 32 pressurized with air, said beams 33 being again supported by transverse box beams 34. The pressure effective in the hoses 32 can be adjusted so that the load of the members against the lower wire 20 and the fiber mesh increases gradually in the direction of running of the wires 10,20. In the hoses 32, quite low pressure in the direction of running of the wires 10,20. In the hoses 32, quite low pressure is used, for example, from about 10 to about 50 cm $H_2O$, whereby a very gentle compression is applied to the web W that is in the stage of formation, and the dewatering pressure is self-adjusting. The fact of the members 30 in the equipment is provided with transverse grooves 35 extending across the entire width of the wire 20, said grooves permitting slight dewatering also through the lower wire 20, and whereby microturbulance that improves the formation of the web W is also produced.

In FIG. 5, the dewatering process is continued in the area between the line of incidence of the upper face of the web W and the profile bar 52, where a layer of water is formed on the inner face of the upper wire 10, which water layer is gathered in the wedge-shaped space between the wire 10 and the profile bar 52 and in the following gap E between the profile bar 52 and the foil rib, through which gap the water is formed through the duct 46*a* into the first chamber 46 in the dewatering means, either by the effect of its kinetic energy and/or by the effect of a vacuum present in the chamber. The profile bar 52 can be set by means of adjusting means 53 in the vertical direction, whereby it is possible to regulate the amount of water, and possible also the amount of air, entering into the duct 46*a*. These adjustments, both in respect of the angle of incidence d between the wires 10 and 20 and the gap passing into the duct 46*a* as well as in respect of the pressure applied to the support system, of course, depend on the paper or board quality produced.

In some cases, the suction-aided system shown in FIG. 5 and based on the use of a regulating bar 52 can be substituted for by a construction in which the regulating bar 52 has been replaced by a roll, whose speed of rotation and height position, i.e. distance from the wire 10, have been arranged adjustable.

It is typical of the MB-units 50 shown in FIGS. 2 to 5 that the press and support unit 30 is placed below and the dewatering means 40 which comprise suction and foil means are placed above, whereby the unit 30 substantially prevents dewatering that takes place by the force of gravity downwards through the carrying wire. In FIG. 1, the first MB-unit 50A complies with the feature mentioned above, whereas the latter NB-unit 50B has been arranged to operate in the opposite direction.

In the following, the operation of the web formers described above and different variations of said operation will be dealt with.

On the sector a of the first forming roll 21;11, the dewatering takes place in two directions, in FIGS. 1 and 2 mainly in the direction of the arrow F1, because the first forming roll 21,11 has an open face 21'; 11. In such embodiments, a dense layer is couched on the sector a, onto the face of the wire 10;20 placed outside by the effect of the dewatering in the direction F1, and so also at the side of the opposite wire 20;10.

The first forming roll 11;21 drains water in both directions, mainly out of reasons related to porosity and formation. The magnitude of the sector a is within the range of a = from about 5° to about 120°, and preferably a = from about 35° to about 55°. The diameter of the first forming roll 21;11 is preferably of an order of $D_1 = 1.5$ m or larger. After the sector a, the dry solids content of the pulp layer is $k_1$ = from about 9 to about 14%. After the second forming roll 24, the dry solids content is $k_3 = 12.777\%$.

In the following Table A, the dewatering proportions in the twin-wire zone in the different embodiment of the invention shown in FIGS. 1 to 4 are shown. The dewatering proportions are denoted in the figures and in Table A with the references F1, F2, F3, F3A, F3B, F4, F4A, F4B. The dewatering proportions given in Table A are average values and may vary within certain limit is dependent on paper quality, other operating parameters and on dimensioning details.

| FIG. | % | F1 | F2 | F3 | F3A | F3B | F4 | F4A | F4B |
|---|---|---|---|---|---|---|---|---|---|
| FIG. 1 | | 40 | 35 | | 12 | 10 | 3 | | |
| FIG. 2 | | 40 | 35 | 22 | | | 3 | | |
| FIG. 3 | | 48 | 40 | 10 | | | 2 | | |
| FIG. 4 | | 40 | 35 | | 10 | 8 | | 5 | 2 |

From the information provided in Table A, it is readily apparent that a larger proportion of dewatering can be carried out on the first forming roll 21:11, and on the roll a larger covering sector a and suction zone or zones can be employed, because by means of the MB-unit 50 or units 50A,50B following after the first forming roll, a pulsating and more intensive dewatering pressure can be achieved than by means of a corresponding ribbed shoe. The dewatering effect of the MB-unit 50 or units 50A and 50B can also be regulated better than in prior art.

It is typical of the MB-unit 50 or units 50A, 50B that through them the wires 10,20 and the web W placed between them run as a straight run, which provides the advantage that the wire 10,20 speeds can be equal, compared with one another, whereby internal working is not produced in the web, which working is typical, e.g. in the case of curved forming shoes and arises from a difference in wire speeds.

A former as shown in FIGS. 1, 2 and 3 is best suitable for the manufacture of newsprint, whereas a former in accordance with FIG. 4, whose dewatering capacity is quite high, is best suitable for the manufacture of fine paper and SC-paper.

The examples provided above are not meant to be exclusive. Many other variations of the present invention would be obvious to those skilled in the art, and are contemplated to be within the scope of the appended claims.

What is claimed is:

1. A twin-wire web former in a paper machine, comprising a covering wire and a carrying wire, said wires defining a twin-wire forming zone with one another, a dewatering unit, a headbox having a discharge opening, said discharge opening of said headbox feeding a pulp suspension jet into a forming gap at a beginning of said twin-wire forming zone to thereby form a web, a first forming roll located at said beginning of said twin-wire forming zone and defining a twin wire turning sector, said twin-wire turning sector being structured and arranged as a dewatering zone, the magnitude of a curvature of said twin-wire turning sector placed in connection with said first forming roll being from about 35° to about 120°.

a second forming roll in said twin-wire forming zone, said second forming roll being located after said dewatering unit, the web being detached from said covering wire and passed on said carrying wire to a pick-up point, said dewatering unit located in said twin-wire zone between said first forming roll and said second forming roll, said dewatering unit comprising a press-support unit structured and arranged to guide said covering and said carrying wires to contact said press-support unit, said dewatering unit further comprising dewatering equipment provided with suction and foil means, said dewatering equipment facing said press-support unit such that said wires run between said dewatering equipment and said press-support unit, said dewatering equipment removing a substantial amount of the remaining water out of the web, said first forming roll arranged above said forming gap, said first forming roll being arranged inside a loop of said covering wire or inside a loop of said carrying wire, said second forming roll arranged inside the same or the other of said loops from said first forming roll, said wires defining a joint straight run between said first forming roll and continuing along said twin-wire forming zone and through said dewatering unit to an opposite end thereof closest to said second forming roll, said dewatering equipment arranged inside said loop of said covering wire or inside said loop of said carrying wire, said press-support unit being arranged inside the other of said loops from said dewatering equipment.

2. The web former of claim 1, wherein the magnitude of said twin-wire turning sector placed in connection with said first forming roll is from about 35° to about 55°.

3. The web former of claim 1, wherein said press-support unit is placed underneath and inside said loop of said carrying wire, and said dewatering equipment is placed above and inside said loop of said covering wire.

4. The web former of claim 3, wherein said first forming roll is arranged inside a loop of said carrying wire and said second forming roll is arranged inside a loop of said covering wire.

5. The web former of claim 3, wherein said first forming roll and/or said second forming roll have an open, perforated cylinder mantle, a suction chamber placed inside said mantle extending substantially over a sector of said mantle which contacts one of said wires.

6. The web former of claim 5, wherein said first and said second forming rolls are placed inside a same wire loop.

7. The web former of claim 5, wherein said first and said second forming rolls are placed inside a loop of said carrying wire.

8. The web former of claim 7, wherein said covering wire and said carrying wire have an upward inclined straight run between said first and said second forming roll, and said dewatering unit comprises first and second dewatering units, said first and second dewatering units being fitted on said upward inclined straight run, said press-support unit of said first dewatering unit being placed underneath and inside a loop of said carrying wire, and said second dewatering unit is arranged to operate in an opposite direction to said first dewatering unit, said second dewatering unit including a press-support unit placed inside a loop of said covering wire and said dewatering equipment being placed inside a loop of said carrying wire.

9. The web former of claim 1, wherein said first forming roll is arranged above said forming gap inside said loop of said covering wire and said second forming roll is arranged inside said loop of said carrying wire, said press-support unit is placed underneath and inside said loop of said carrying wire.

10. The web former of claim 1, wherein said first and said second forming rolls are positioned substantially in the same horizontal plane, a substantially horizontal joint run of said carrying and covering wires running between said first and second forming rolls, said dewatering unit being arranged on said substantially horizontal joint run, and press-support unit being located underneath and inside said loop of the carrying wire.

11. The web former of claim 10, wherein a forming shoe having a curved guide deck is located inside said loop of said carrying wire after said first forming roll, said shoe being followed by a straight run of said wires on which said dewatering unit is arranged, followed by said second forming roll.

12. The web former of claim 11, wherein said forming shoe has an open ribbed deck.

13. The web former of claim 11, further comprising a third forming roll located above said second forming roll said covering wire being separated from said web after contacting said third forming roll.

14. The web former of claim 1, wherein said dewatering equipment is arranged inside the other of said loops from said first forming roll.

15. The web former of claim 14, wherein said second forming roll is arranged inside the other of said loops from said first forming roll.

16. The web former of claim 14, wherein said wires define a joint straight run beginning at said first forming roll and extending to said second forming roll.

17. The web former of claim 1, wherein said first forming roll is arranged above said forming gap inside a loop of said carrying wire and said second forming roll is arranged inside a loop of said covering wire, said dewatering equipment being arranged underneath and inside said loop of said covering wire.

* * * * *